US006478632B2

(12) United States Patent
Tanaka

(10) Patent No.: US 6,478,632 B2
(45) Date of Patent: Nov. 12, 2002

(54) SHAKE PREVENTING CONSTRUCTION FOR A TERMINAL FITTING AND A CONNECTOR

(75) Inventor: Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/835,602

(22) Filed: Apr. 16, 2001

(65) Prior Publication Data

US 2001/0034166 A1 Oct. 25, 2001

(30) Foreign Application Priority Data

Apr. 28, 2000 (JP) ..... 2000-129471
May 25, 2000 (JP) ..... 2000-154028

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,851,128 A * 12/1998 Nakata et al. ..... 439/752
5,997,364 A * 12/1999 Matsuoka et al. ..... 439/752
5,997,365 A * 12/1999 Abe ..... 439/752
6,071,153 A * 6/2000 Fink et al. ..... 439/752
6,080,023 A * 6/2000 Meulemeester et al. .... 439/752
6,116,954 A * 9/2000 Ries ..... 439/752

FOREIGN PATENT DOCUMENTS

JP 11-204185 7/1999

* cited by examiner

*Primary Examiner*—Gary F. Paumen
(74) *Attorney, Agent, or Firm*—Anthony J. Casella; Gerald E. Hespos

(57) ABSTRACT

A connector has a housing (9) with cavities (16) for accommodating terminal fittings (5). A retainer (15) can be mounted in the housing (9), such that a locking portion (18) on the retainer (15) contacts the upper edges of receiving pieces (U) of terminal fittings (5). Thus, the terminal fittings (5) do not shake in cavities (16), and fine sliding abrasion is avoided. The receiving piece (U) is spaced from the wire-crimping barrels and thus is not influenced by variations of the diameter of a wire (W). The retainer (15) has a terminal locking portion (18) for engaging connecting portions (6) of the terminal fittings (5). The space between the locking portion (18) and the front-stop wall (28) of the retainer (15) equals the length of the connecting portions (6) of the female terminal fittings (5). Thus, the locking portion (18) can be engaged with rear ends of the connecting portions (6).

13 Claims, 11 Drawing Sheets

SHAKE PREVENTING CONSTRUCTION FOR A TERMINAL FITTING AND A CONNECTOR

BACKGROUND OF THE INVENTION

1. Field of the Invention

The invention relates to a connector and a construction for preventing a terminal fitting from shaking in a connector housing.

2. Description of the Related Art

A conventional connector housing has opposite front and rear ends and a cavity that penetrates through the housing from the rear end to the front end. An elastic locking piece is cantilevered obliquely and forwardly from a wall of the housing into the cavity. A terminal fitting can be inserted into the cavity from behind and locked into engagement with the leading end of the elastic locking piece.

Some connectors are used in high vibration environments, such as in automotive vehicles. Vibrations in these environments cause mated terminal fittings to rub against each other at a high speed and can abrade the contact portions. Fine sliding abrasion can be restricted by preventing vibration of the terminal fittings in the cavities. Therefore, suitable members may be held in contact with the terminal fittings to prevent vibrations.

Some known connectors prevent fine sliding abrasion by pressing the barrel of the terminal fitting or by pressing the insulation coating of the wire. However, these connectors still have problems. Specifically, the same terminal fitting may be used to connect wires that have different diameters. In this case, a contact member for pressing the wire may not contact the wire, depending upon the diameter of the wire. Similarly, the height of a barrel that is crimped into connection with a core or an insulation coating of the wire will vary depending on the diameter of the wire. Thus a contact member for contacting the barrel may not reach the crimped barrel. In these situations, the problem of fine sliding abrasion cannot be solved.

Some connectors include both elastic locking pieces and a retainer for securely locking terminal fittings in a connector housing. An example of such a connector is disclosed in Japanese Unexamined Patent Publication No. 11-204185 and is illustrated in FIG. 20 herein. The connector of FIG. 20 includes a terminal 50 and a connector housing 51. The connector housing 51 is formed with a cavity 52 that has a front wall 53. The terminal 50 can be inserted into the cavity 52 in a rear-to-front direction until the terminal 50 engages the front wall 53 of the cavity 52. A cantilever-shaped lock 54 extends from a bottom wall of the cavity 52 to elastically engage and lock a bottom side of the terminal 50. A retainer 55 is mounted on the upper surface of the connector housing 51 to engage and lock the upper surface of the terminal 50. Thus, the terminal 50 is prevented from backing out of the cavity 52.

The connector of FIG. 20 has a problem because the terminal 50 shakes in the cavity 52. The shaking occurs because the lock 54 is elastically deformed downward when the terminal 50 is inserted. At this time, an engaging position of the lock 54 moves in an arc. Accordingly, the engaging position of the lock 54 differs in a horizontal direction by a specified distance between a position where the lock 54 permits the terminal 50 to pass and a position where the lock 54 is restored elastically to its original shape to lock the terminal 50. This creates a clearance between the terminal 50 and the lock 54 in a state where the lock 54 locks the terminal 50, although this clearance is very small.

The retainer 55 is mounted by pushing straight into the connector housing 51 for mounting. Accordingly, no clearance is formed for the same reason as the lock 54. However, the retainer 55 is formed separately from the connector housing 51, and unlike the lock 54, must create clearances (a) and (b) at a retainer mount position in the connector housing 51 for manufacturing or assembling reasons when the retainer 55 is assembled with the connector housing 51. Thus, the mount position of the retainer 55 varies in forward and backward directions because the retainer 55 is assembled with the connector housing 51, and clearances exist between the terminal 50 and the retainer 55.

The prior art locking construction of FIG. 20 cannot avoid the shape of the terminal 50 in the cavity 52. The use of such a connector in an automotive vehicle will cause vibrations to be transmitted from the vehicle to the connector. Thus, the terminals will shake at a high speed and abrade due to fine sliding.

The present invention was developed in view of the above problems and an object of the invention is to prevent a terminal from shaking in a cavity.

SUMMARY OF THE INVENTION

The invention is directed to a shake preventing construction for a terminal fitting. The construction comprises at least one terminal fitting with a wire connecting portion at one end for connection with a wire. The connector further has a connector housing with at least one cavity for accommodating the terminal fitting. A terminal fixing device is mountable in the connector housing and has a contact portion for contacting the terminal fitting before or near the wire connecting portion to prevent the terminal fitting from shaking. Accordingly, fine sliding abrasion with a mating terminal can be avoided.

The contact portion of the terminal fixing device contacts the terminal fitting at a position spaced from the wire connecting portion, and therefore is not affected by different diameters of wires to be connected. As a result the terminal fitting can be prevented from shaking with a high degree of reliability.

The terminal fixing device preferably comprises a locking portion for locking the terminal fitting in the cavity. Accordingly, the contact portion of the terminal fixing device prevents the terminal fitting from shaking, while the locking portion of the terminal fixing device prevents the terminal fitting from coming out.

The terminal fixing device preferably is formed with a front-stop wall. The front end surface of the terminal fitting can be brought into contact with the front-stop wall for determining a front end position of the terminal fitting. Accordingly, the contact portion of the terminal fixing device prevents the terminal fitting from shaking, while the front-stop wall of the terminal fixing device determines the front end position of the terminal fitting.

The terminal fitting has a connecting portion for connection with a mating terminal fitting. The terminal fitting also may comprise a receiving piece between the connecting portion and the wire connecting portion. The contact portion of the terminal fixing device contacts the receiving piece to prevent shaking of the terminal fitting.

At least one of the terminal fitting and the contact portion of the terminal fixing device may be formed with a guide surface for guiding a locking operation of the terminal fixing device.

The terminal fixing device can be positioned in a partial lock position, such that at least one communication hole in the terminal fixing device substantially aligns with the corresponding cavity. Thus, the terminal fitting can be inserted into the cavity and the communication hole. The contact portion contacts the terminal fitting when the terminal fixing device is in the full locking position to lock the terminal fitting in the cavity.

One contact portion may enter at least two adjacent or neighboring cavities when the terminal fixing device is in the full locking position. Additionally, corresponding opening edges of the communication hole enter the cavity when the terminal fixing device is in the full locking position.

The terminal fitting may be provided with locking means for interacting with mating locking means in the connector housing to provide secondary locking for locking the terminal fitting in the connector housing.

The invention also is directed a connector with a shake preventing construction. The connector comprises at least one terminal fitting with an engaging portion in a position spaced backward from a leading end of the terminal fitting by a specified distance. The connector also comprises a housing with at least one cavity for accommodating the terminal fitting along its longitudinal direction. The cavity may have an opening for exposing the engaging portion to the outside. A terminal retainer is mountable into the housing and has a front-stop wall substantially at the front end of the cavity and held substantially in contact with the leading end of the terminal fitting. The terminal retainer is provided integrally or unitarily with a terminal locking portion spaced backward from the front-stop wall by a specified distance and engageable with the engaging portion.

The specified distance by which the engaging portion is spaced from the leading end of the terminal fitting preferably equals the specified distance by which the locking portion is spaced from the front-stop wall. Thus, the dimensional variations in forward and backward directions provided for manufacturing or assembling reasons in the prior art can be made smaller and, therefore, the shake between the terminal fitting and the terminal locking portion can be suppressed to a maximum extent. As a result, the connector is effective against fine sliding abrasion.

The engaging portion of the terminal fitting and/or the terminal locking portion of the terminal retainer preferably is formed with a guide surface for guiding a locking action of the terminal locking portion of the terminal retainer. Accordingly, the terminal locking portion performs its locking action smoothly.

The terminal retainer is movable between a partial locking position where it is held in the housing so as not to hinder insertion of the terminal fitting into the cavity and a full locking position where the terminal locking portion engages the engaging portion of the terminal fitting to prevent the terminal fitting from coming backwardly out of the cavity.

These and other objects, features and advantages of the present invention will become more apparent upon a reading of the following detailed description and accompanying drawings.

DETAILED DESCRIPTION OF THE PREFERRED EMBODIMENTS

Figure 1:
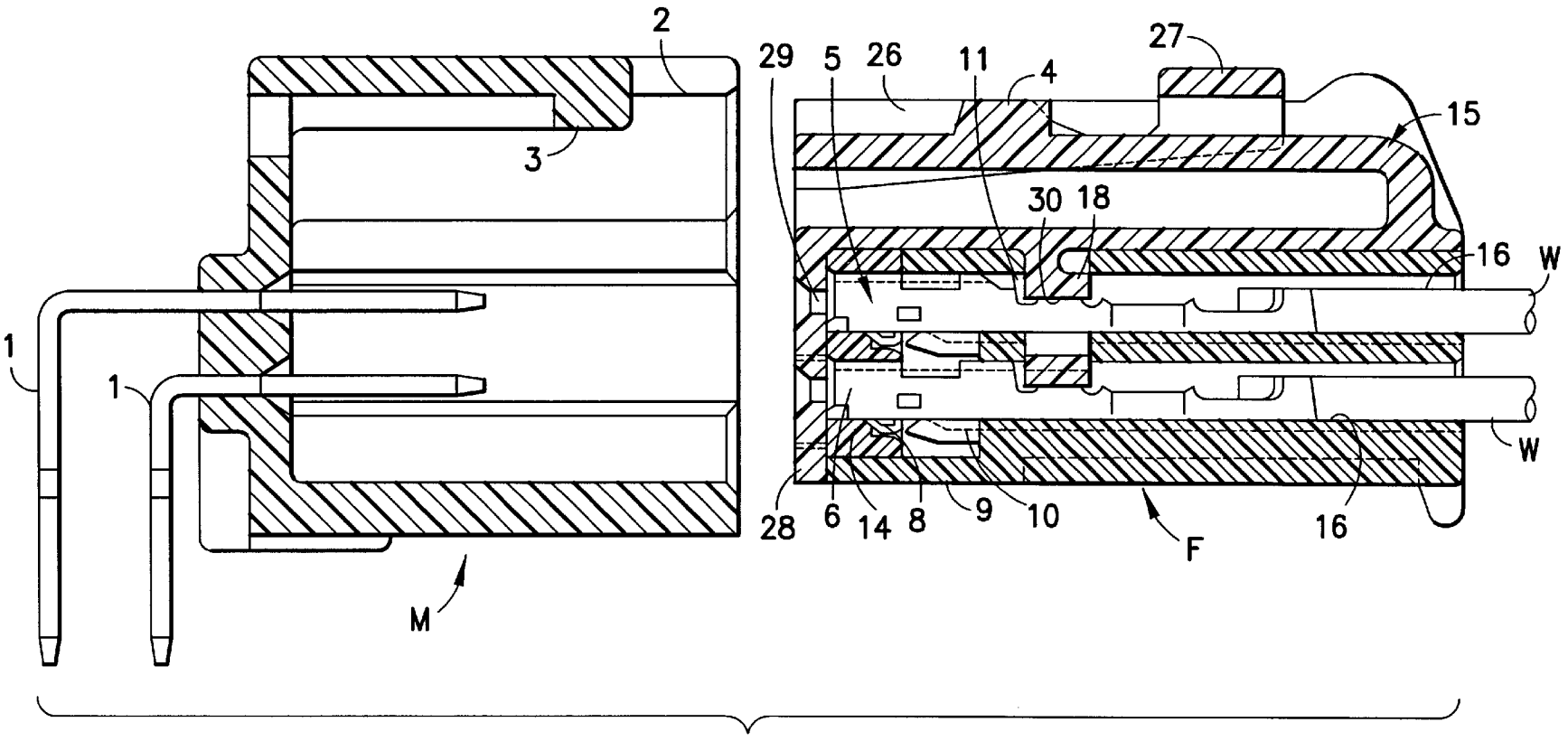
FIG. 1 is a side view in section showing a male connector housing and a female connector housing according to a preferred embodiment of the invention in its full locking position.

FIG. 1 shows male and female connector housings F, M according to one embodiment of the invention. The male connector housing M is a substantially rectangular tube that opens forward, and a plurality of male terminal fittings 1 are pressed into its back wall. Each male terminal fitting 1 extends rearward beyond the back wall of the male connector housing M and the rearward section is bent down at a right angle for connection with wiring on a printed circuit board. A recess 2 is formed at the opening edge in the center of the upper surface of the male connector housing M, and an engaging projection 3 projects down at the back of the recess 2 for engagement with a locking projection 4 on the female connector housing F.

Figure 2:
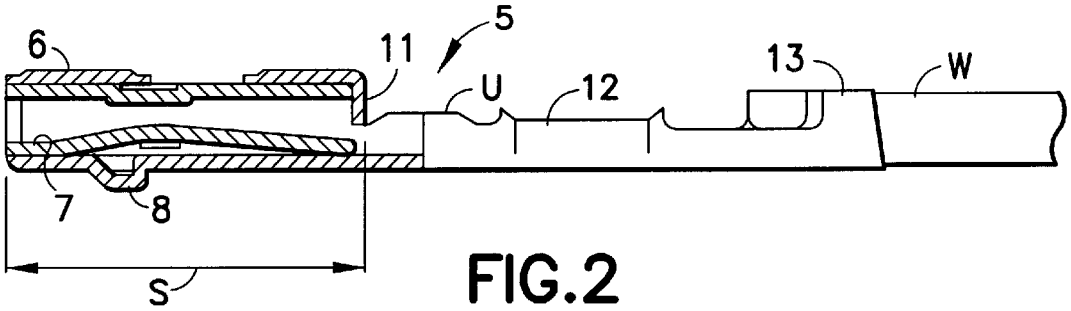
FIG. 2 is a side view in section of a female terminal fitting.
Figure 3:
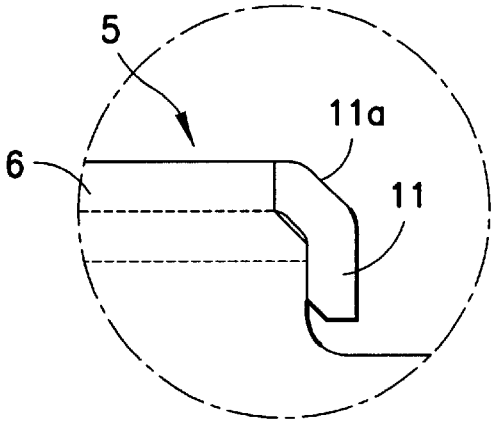
FIG. 3 is an enlarged view showing a contact piece of the female terminal fitting.

The female connector housing F includes at least one female terminal fitting 5, which is illustrated more clearly in FIG. 2. A substantially rectangular tubular connecting portion 6 is formed at the leading end of each female terminal fitting 5, and is connectable with the male terminal fitting 1 when the female and male connector housings F, M are connected. An elastic piece 7 of substantially triangular cross section is folded back at the front end of the bottom wall inside the connecting portion 6, and is designed for elastic contact with the male terminal fitting 1 to establish an electrical connection therewith. An engaging projection 8 projects integrally or unitarily from the bottom surface of the connecting portion 6 and engages with a locking portion 10 of a housing 9 to be described later. Further, a contact piece 11, as shown in FIG. 3, is provided at the rear end of the connecting portion 6. The contact piece 11 is formed by bending an upper end of the connecting portion 6 at its rear end downward, and a sloped guide surface 11*a* is formed on the upper surface of the bent portion for guiding a locking operation of a terminal retainer 15.

A wire barrel 12 is behind the connecting portion for crimped connection with a core of a wire W, and an insulation barrel 13 is behind the wire barrel 12 for crimped connection with an insulation coating of the wire W. Upper edges of opposing sidewalls between the connecting portion 6 and the wire barrel portion 12 serve as receiving pieces U. Each receiving piece U extends substantially horizontally along a longitudinal direction, and can be contacted by the terminal locking portion 18 of the terminal retainer 15 to be described later.

Figure 4:
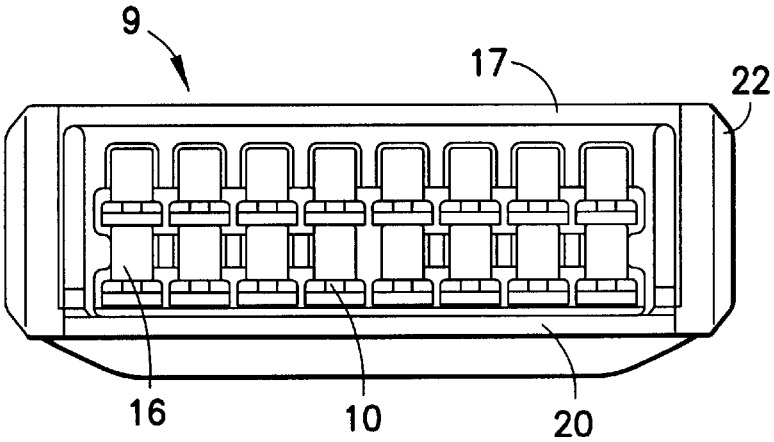
FIG. 4 is a front view of the housing.
Figure 5:
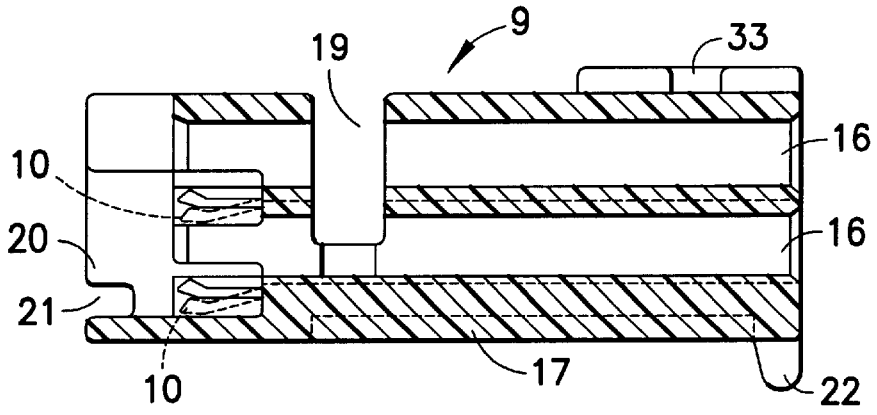
FIG. 5 is a side view in section of the housing.
Figure 6:
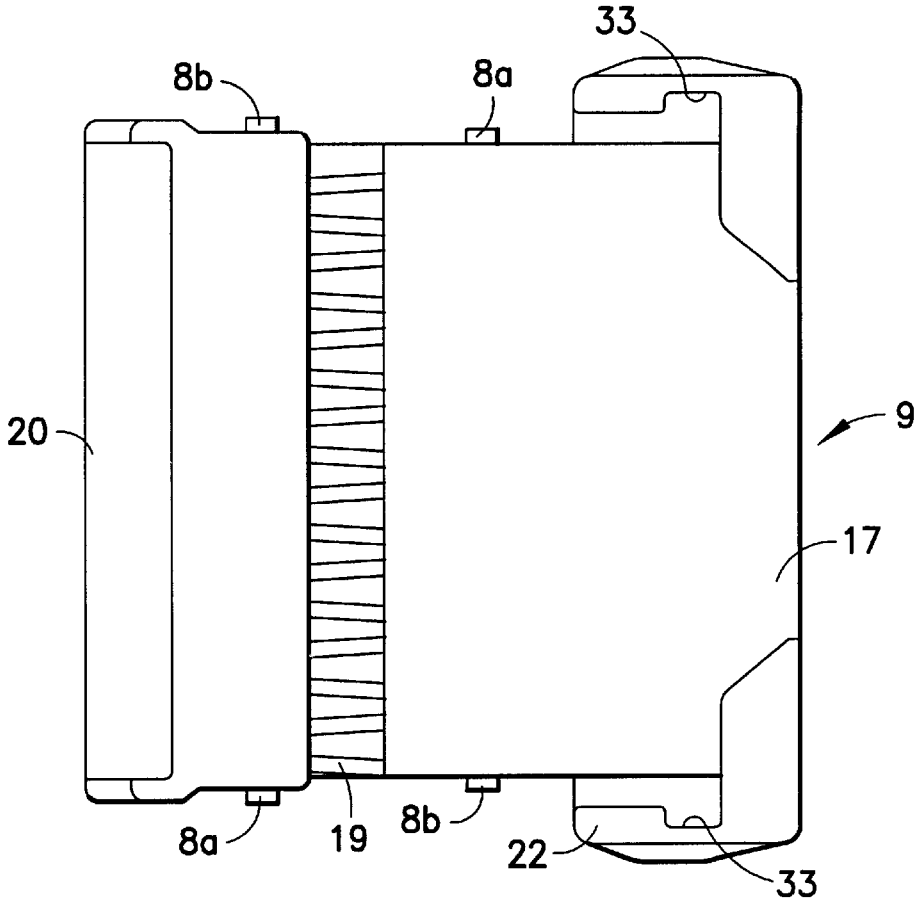
FIG. 6 is a plan view of the housing.

The female connector housing F comprises the housing 9, a housing head 14 and the terminal retainer 15. The housing 9, as shown in FIGS. 4 to 6, has a main body 17 substantially in the form of a laterally long rectangular parallelepiped. Cavities 16 are provided side by side in a widthwise direction at upper and lower stages of the main body 17 and hold female terminal fittings 5 in close contact over their entire circumference. A vertically deformable locking portion 10 is formed in the bottom surface at the front end of each cavity 16. The locking portion 10 is deformed when the female terminal fitting 5 is inserted into the cavity 16, to permit passage of the female terminal fitting 5, and then is restored substantially to its original shape after the passage of the female terminal fitting 5 for engagement with the engaging projection 8 of the female terminal fitting 5.

A mount hole 19 is open from the upper surface to the opposite side surface of the main body 17 of the housing 9, and is dimensioned to receive the terminal locking portion 18 of the terminal retainer 15. The mount hole 19 is formed such that the rear end surfaces of the contact pieces 11 and the front opening edge of the mount hole 19 are substantially flush with each other when the female terminal fittings 5 are accommodated properly in the housing 9. Further, partial and full locking projections 8*a*, 8*b*project at different heights on the opposite outer surfaces of the main body 17 and on the opposite side of the mount hole 19 for locking the terminal retainer 15. The partial locking projections 8*a* and the full locking projections 8*b* are arranged diagonally or displaced longitudinally with respect to each other, as shown in FIG. 6.

A bulging portion 20 is formed at the front end of the main body 17 and substantially surrounds front parts of the respective locking portions 10. The bulging portion 20 is open forward and upward, and the housing head 14, to be described later, can be accommodated in a space defined by the opposite side surfaces and the bottom surface of the bulging portion 20. Notches 21 are formed at the lower corners of the opposite side surfaces of the bulging portion 20 for preventing the housing head from disengaging.

An operable portion 22 bulges out at the rear of the main body, and is used to connect and disconnect the female and male connector housings F, M. Further, longitudinal guide grooves 33 are formed in the inner surfaces of the opposite sides of the operable portion 22. Coupling projections 34 of the terminal retainer 15 slide into the guide grooves 33 to couple the housing 9 and the terminal retainer 15 or to connect the inner and outer housings.

Figure 7:
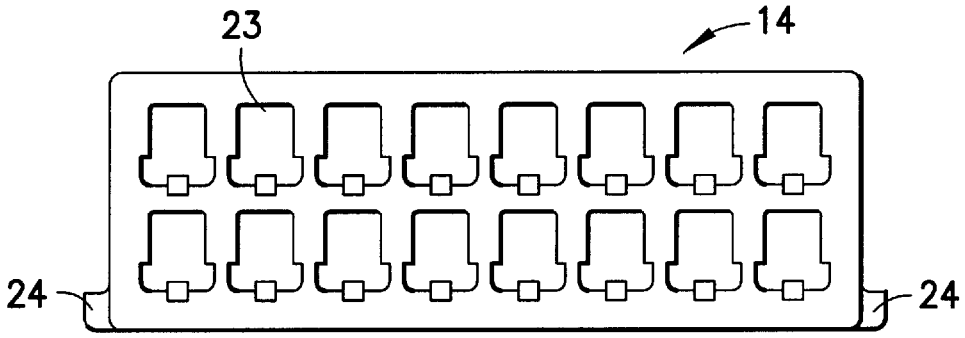
FIG. 7 is a front view of a housing head.
Figure 8:
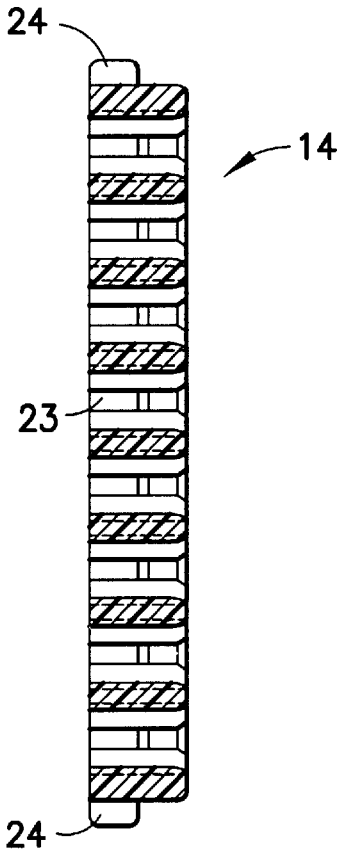
FIG. 8 is a plan view in section of the housing head.

The housing head 14 (see FIGS. 7 and 8) is formed to align with the back surface of the bulging portion 20 when the housing head 14 is accommodated in the bulging portion 20 of the main body 17. Additionally, the housing head 14 is lattice-shaped, and is formed with windows 23 that can communicate with the corresponding cavities 16. A hook 24 projects at the bottom end of each of the opposite side surfaces of the housing head 14. The hooks 24 can engage the notches 21 of the bulging portion 20 when the housing head 14 is accommodated in the bulging portion 20 from front, thereby preventing the housing head 14 from disengaging upward.

Figure 9:
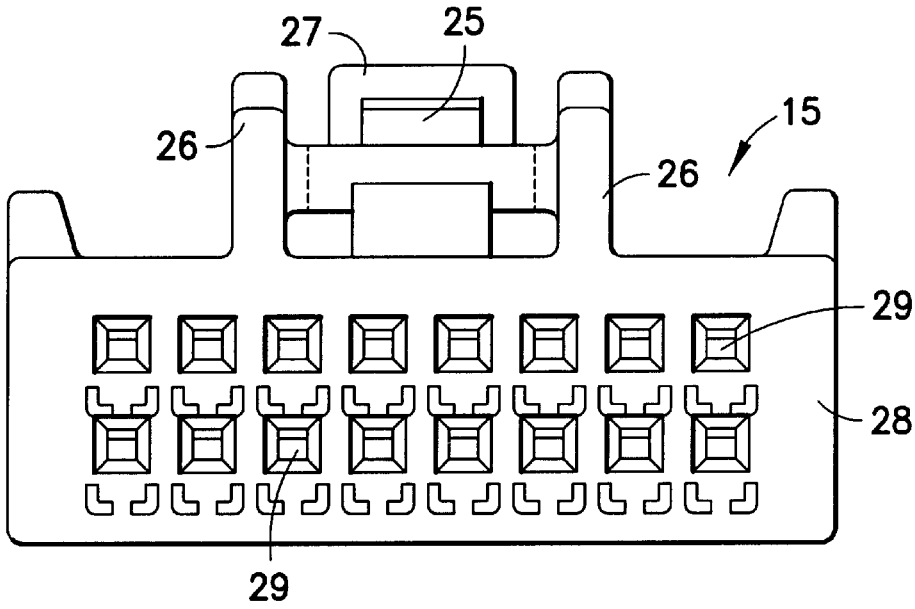
FIG. 9 is a front view of a terminal retainer.
Figure 10:
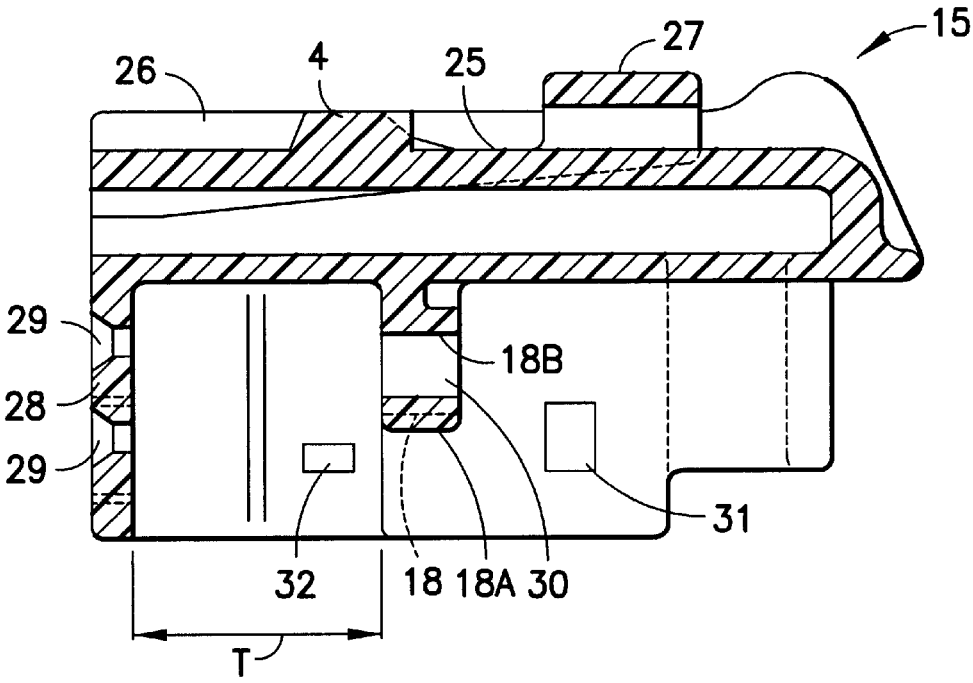
FIG. 10 is a side view in section of the terminal retainer.
Figure 11:
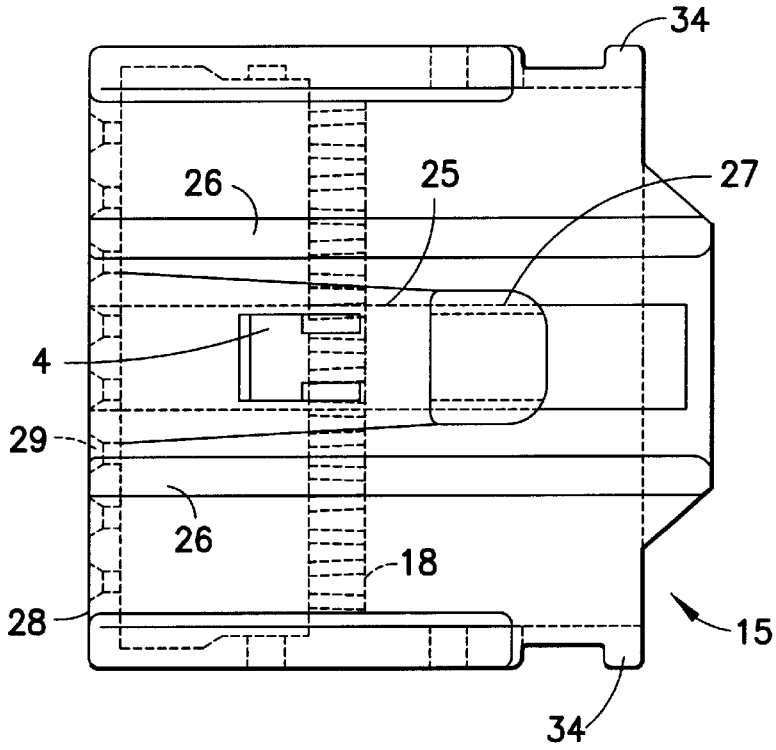
FIG. 11 is a plan view of the terminal retainer.

The terminal retainer 15 is substantially in the form of a box that opens downward and backward, as shown in FIGS. 9–11. Thus, the terminal retainer 15 can be fit into the housing 9 from above. A lock arm 25 extends in forward and backward directions on the upper surface of the terminal retainer 15 for locking the female and male connector housing F, M together, and the locking projection 4 projects slightly more forward than the center of this upper surface. The rear end of the lock arm 25 is connected with the upper surface of the terminal retainer 15, whereas the front end of the lock arm 25 is connected with substantially parallel protection walls 26 at opposite sides of the lock arm 25. Accordingly, the lock arm 25 is supported at its front and rear ends, and the locking projection 4 can engage with the engaging projection 3 of the male connector housing M. Further, an operable piece 27 projects behind the locking projection 4 on the upper surface of the lock arm 25 for disengaging the locking projection 4 from the engaging projection 3. Pressing the operable piece 27 elastically deforms the lock arm 25 in disengaging direction.

A front stop wall 28 is formed at the front of the terminal retainer 15 and is held in contact with the front surface of the housing head 14 when the terminal retainer 15 is fitted into the housing 9. Additionally, the front end surfaces of the female terminal fittings 5 are brought into contact with the front stop wall 28. Male terminal insertion openings 29 are formed in the front stop wall 28 and align with the respective cavities 16 and windows 23.

Figure 12:
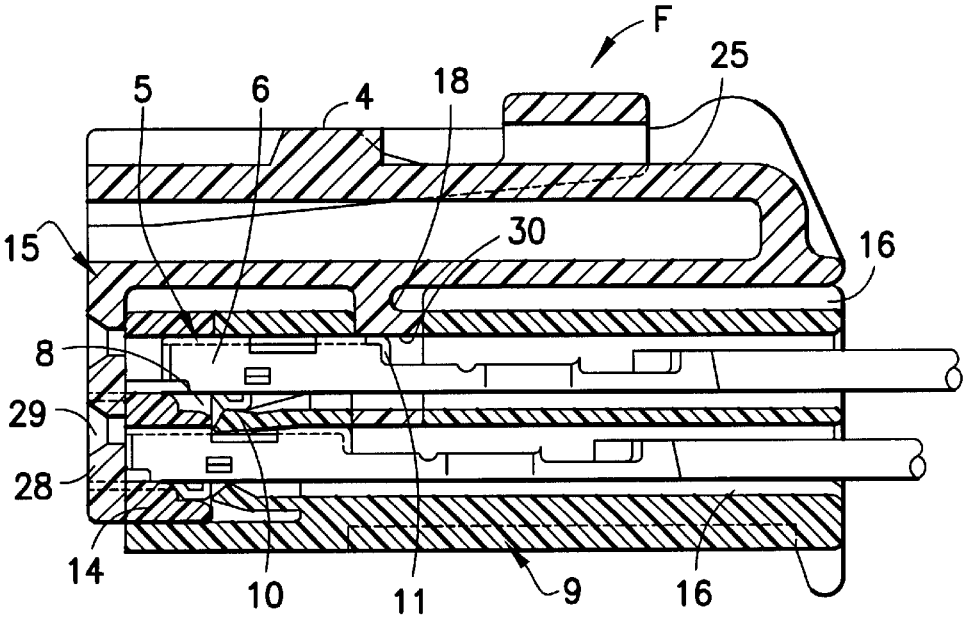
FIG. 12 is a side view in section showing an insertion process of the terminal fitting when the terminal retainer is in a partial locking position.

The terminal locking portion 18 extends unitarily down from the ceiling of the terminal retainer 15 over substantially the entire width. The front surface of the terminal locking portion 18 is located a distance T from the inner surface of the front-stop wall 28, as shown in FIG. 10. The distance T substantially equals the distance S from the front surface of the connecting portion 6 to the rear surface of the contact piece 11 on the female terminal fitting 5, as shown in FIG. 2. Communication holes 30 are formed in the terminal locking portion 18 and correspond in number and location to the cavities 16 at the upper stage of the front stop wall 28. As described later, the communication holes 30 align with the corresponding cavities 16 when the terminal retainer 15 is in a partial locking position in the housing 9, as shown in FIG. 12, and lower parts of the opening edges of the communication holes 30 do not enter the cavities 16 at the lower stage. Thus, insertion of the female terminal fittings 5 into the respective cavities 16 of the housing 9 is permitted when the retainer 15 is in its partial locking position. However, the upper and lower ends of the opening edges of the communication holes 30 enter the respective cavities 16 at the upper and lower stages when the terminal retainer 15 is in a full locking position in the housing 9 (see FIG. 1). Thus, female terminal fittings 5 in a proper insertion position abut against the front-stop wall 28, and the terminal locking portion 18 is held in close contact with the contact pieces 11 to prevent the female terminal fittings 5 from moving backward out of the cavities 16.

The terminal locking portion 18 that is in the full locking position in the housing 9 contacts the receiving pieces U of the corresponding female terminal fittings 5. Specifically, bottom end surfaces 18A of the terminal locking portion 18 and upper ends 18B of the opening edges of the respective communication holes 30 are substantially horizontal, and have a forward and backward dimension slightly longer than the receiving pieces U. Therefore, the surfaces 18A and 18B can contact the receiving pieces U of the female terminal fittings 5 substantially over their entire lengths of the receiving pieces U.

Figure 17:
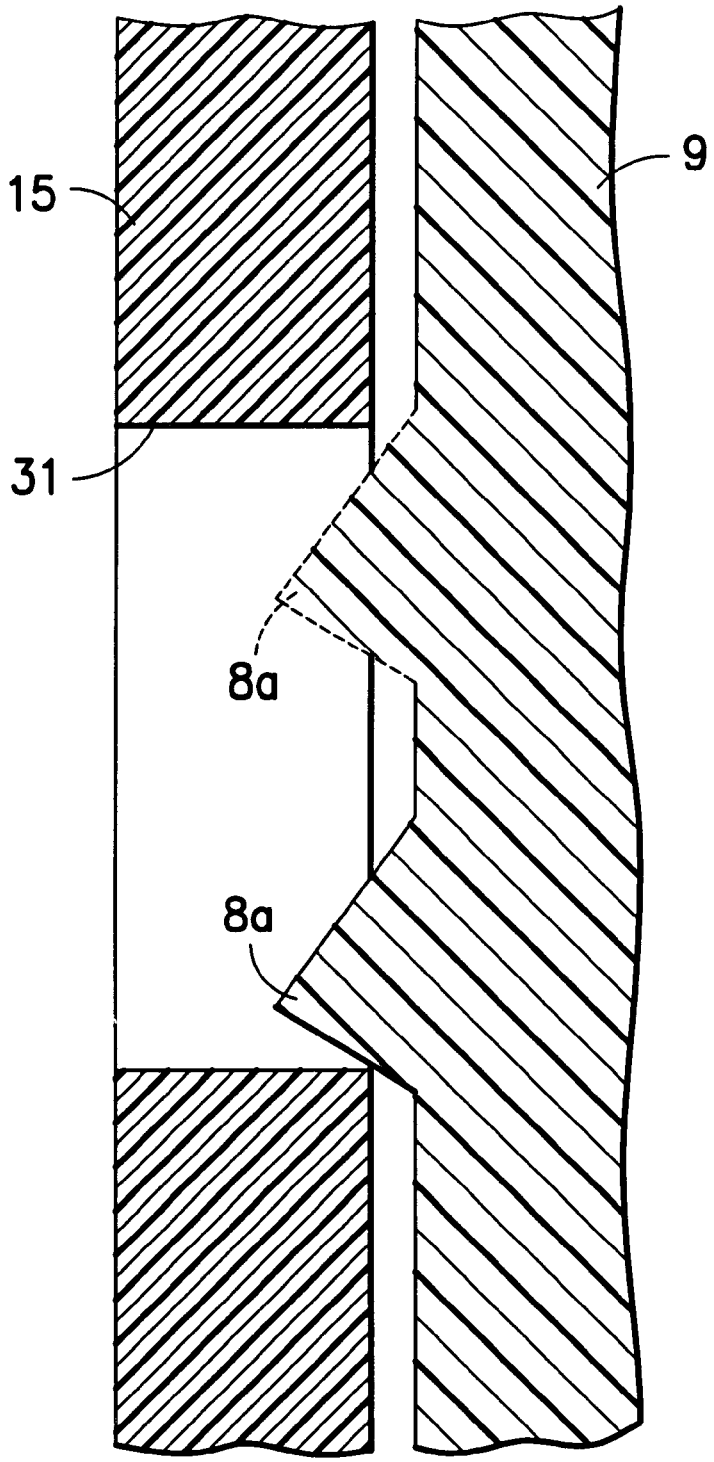
FIG. 17 is an enlarged section showing partial and full locking states of a first locking portion.
Figure 18:
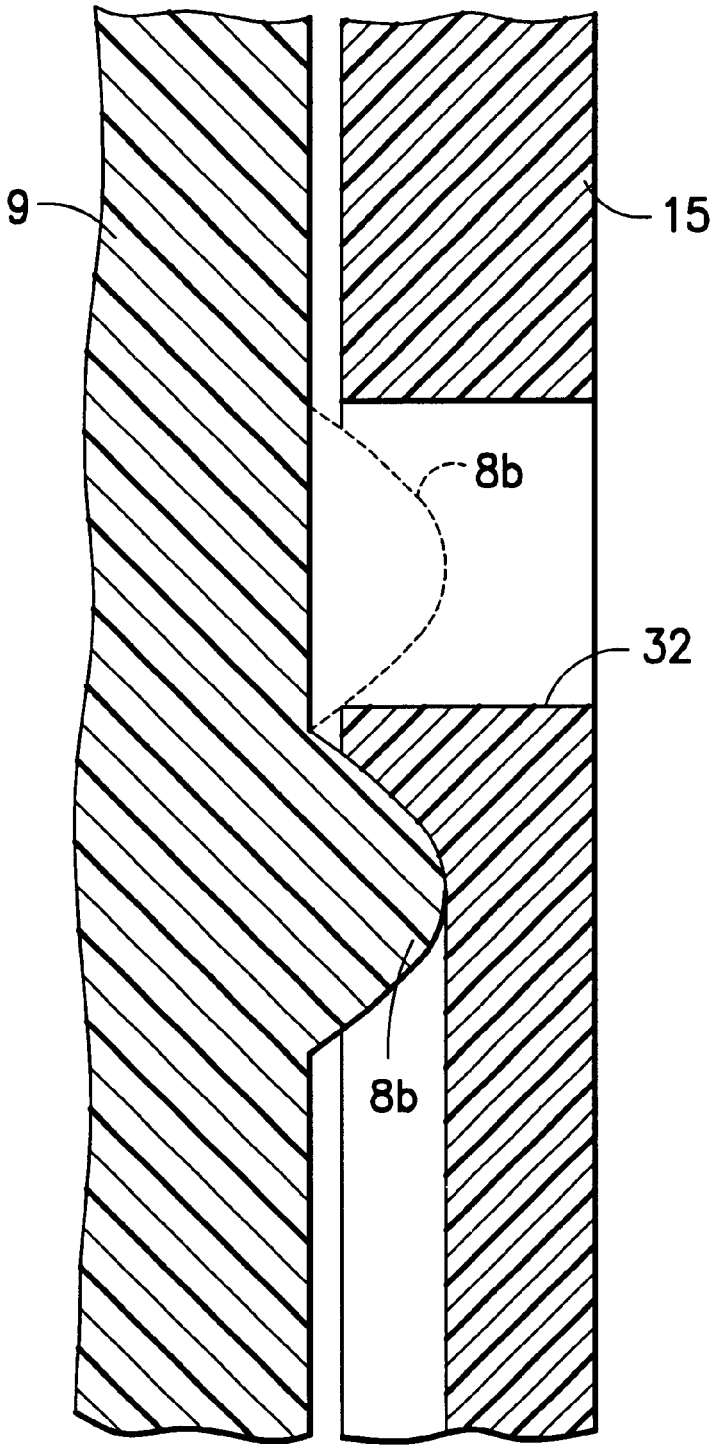
FIG. 18 is an enlarged section showing partial and full locking states of a second locking portion.
Figure 19:
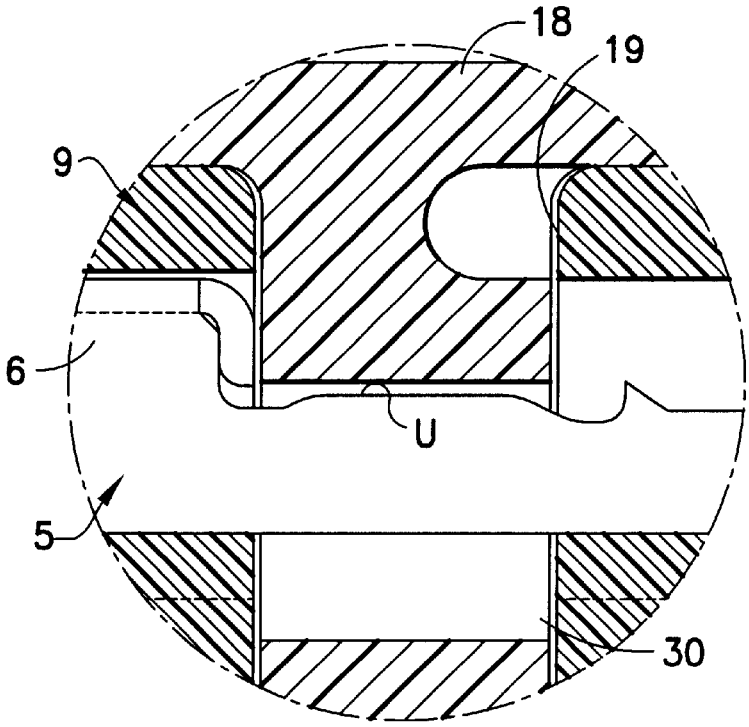
FIG. 19 is an enlarged section showing a contact state of a terminal locking portion and a receiving piece.
Figure 20:
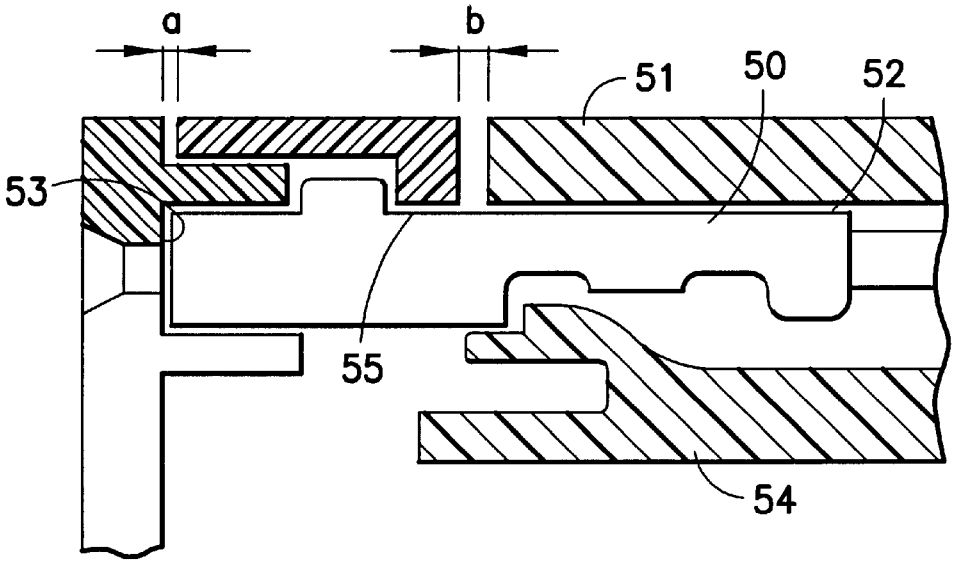
FIG.20 PRIOR ART
FIG. 20 is a section showing a prior art connector.

Opposite side walls of the terminal retainer 15 have partial and full locking holes 31, 32 that correspond to the partial and full locking projections 8*a*, 8*b* of the main body 17. The respective pairs of partial and full locking projections 8*a*, 8*b* are arranged diagonally or spaced longitudinally with respect to each other, as described above, and the partial and full locking holes 31, 32 are in a similar or corresponding arrangement. The partial locking holes 31 are oblong and are long in height direction. The partial locking projections 8*a* engage the bottom edges of the partial locking holes 31, as shown in FIG. 17, when the terminal retainer 15 is in the partial locking position. However, the partial locking projections 8*a* are in intermediate positions of the partial locking holes 31, as shown by phantom line in FIG. 17, when the terminal retainer 15 is in the full locking position. On the other hand, the full locking projections 8*b* engage stepped portions below the bottom ends of the opening edges of the full locking holes 32, as shown in FIG. 18, when the terminal retainer 15 is in the partial locking position. However, the full locking projections 8*b* are in the full locking holes 32 when the terminal retainer 15 is in the full locking position, as shown by phantom line in FIG. 18.

The coupling projections 34 are at the rear end of the opposite side surfaces of the terminal retainer 15, and can be inserted into the guide grooves 33 of the housing 9.

The female connector housing F is assembled by first accommodating the housing head 14 in the bulging portion 20 of the main body 17. At this stage, the hooks 24 of the housing head 14 are engaged with or pressed into the notches 21 of the main body 17.

Figure 13:
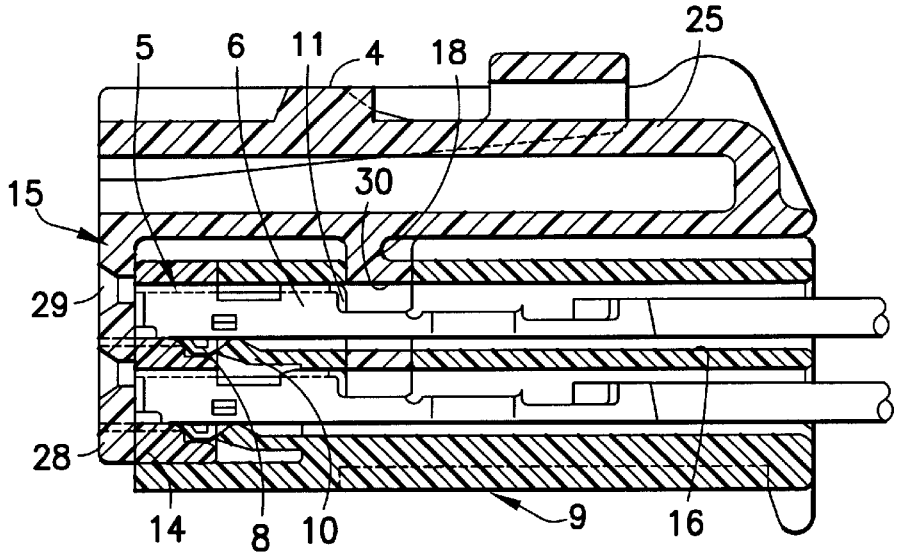
FIG. 13 is a side view in section showing a completely inserted state of the terminal fittings.
Figure 14:
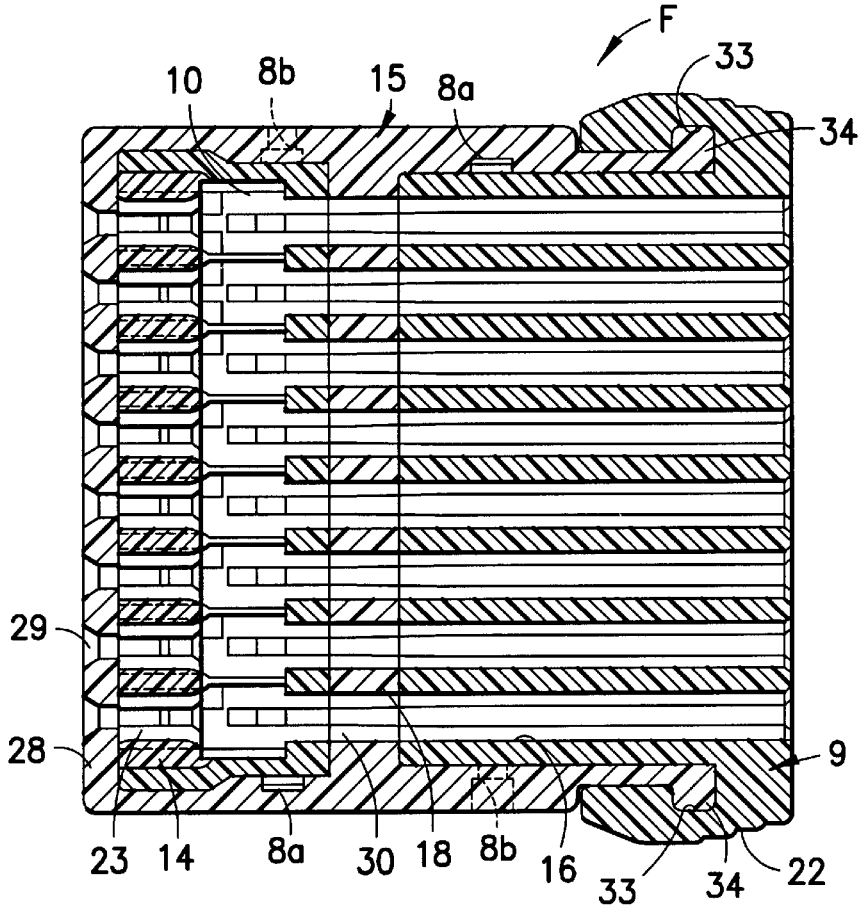
FIG. 14 is a plan view in section of the female connector housing.
Figure 15:
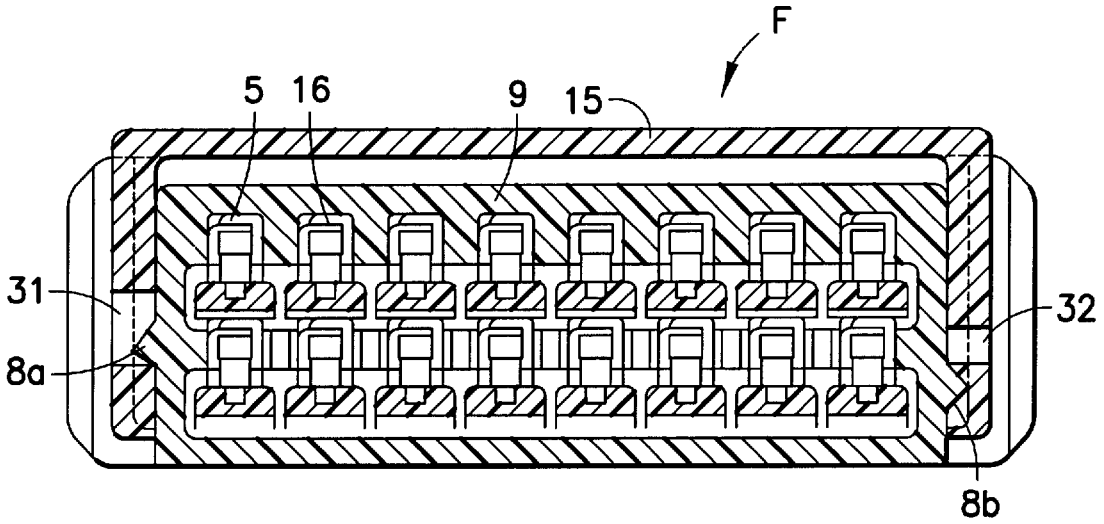
FIG. 15 is a front view in section of the female connector housing in its partial locking position.
Figure 16:
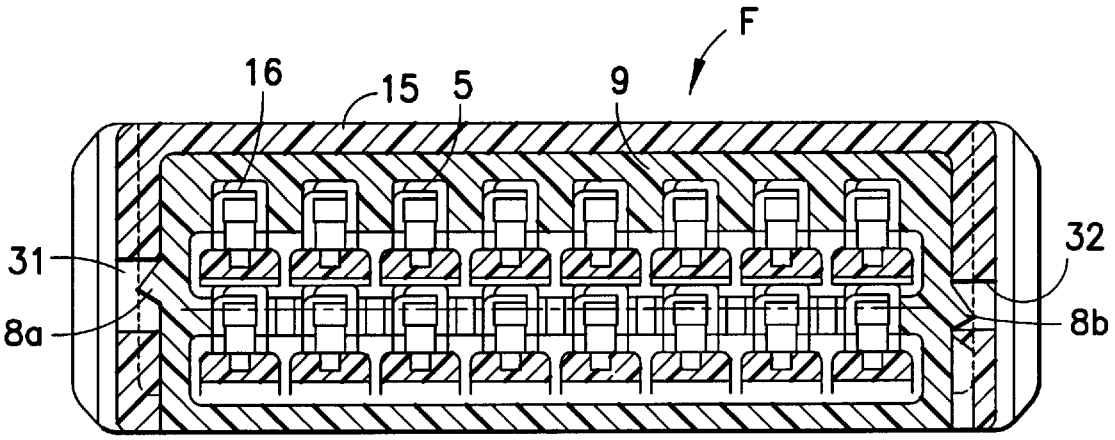
FIG. 16 is a front view in section of the female connector housing in its full locking position.

The terminal retainer 15 is fit into the assembly of the housing 9 and the housing head 14 from above while the coupling projections 34 align with the guide grooves 33. At this stage, the terminal locking portion 18 of the terminal retainer 15 fits into the mount hole 19 of the main body 17. Further, the partial locking projections 8*a* engage the partial locking holes 31 and the full locking projections 8*b* engage the stepped portions below the full locking holes 32. Accordingly, the terminal retainer 15 is prevented both from up or down and is held in the partial locking position with respect to the housing head 14 and the housing 9, as shown in FIGS. 12, 13 and 15.

The front-stop wall 28 closely contacts the front surface of the main body 17 when the retainer is in the partial locking position. Additionally, the communication holes 30 of the terminal retainer 15 align with the cavities 16, but the male terminal insertion openings 29 in the front stop wall 28 do not align with the cavities 16. Accordingly, female terminal fittings 5 inserted into the respective cavities 16 from behind can pass through the communication holes 30 in the cavities 16 at the upper stage and can pass below the terminal locking portion 18 in the cavities 16 at the lower stage. Further pushing causes the female terminal fittings 5 to deform the respective locking portions 10 elastically downward sufficiently for the female terminal fittings 5 to proceed past the locking portions 10 and into abutting engagement with the rear surface of the front-stop wall 28. In this way, the front end positions of the female terminal fittings 5 are determined. The respective locking portions 10 are restored elastically and engage the engaging projections 8 after the female terminal fittings 5 are inserted to their proper insertion positions. Thus, the female terminal fittings 5 are locked partly in the female connector housing F.

The terminal retainer 15 is pushed further into the housing 9 and the housing head 14 after insertion of the female terminal fittings 5. Thus, the ceiling surface of the terminal retainer 15 is brought into close contact with the upper surface of the main body 17. This causes the partial locking projections 8*a* to move to the intermediate positions in the partial locking holes 31 and causes the full locking projections 8*b* to engage the full locking holes 32. In this way, the terminal retainer 15 is locked in the housing 9. In the full locking position, the upper ends of the opening edges of the communication holes 30 and the bottom end of the terminal locking portion 18 enter the respective cavities 16 at the upper and lower stages and lock the female terminal fittings 5 while being held in close contact with the contact pieces 11 thereof. Simultaneously, the bottom end of the terminal locking portion 18 and the upper ends of the opening edges of the communication holes 30 contact the upper edges of the receiving pieces U of the corresponding female terminal fittings 5. As a result, the respective female terminal fittings 5 are held so as not to shake in the cavities 16. The insertion openings 29 of the front-stop wall 28 are aligned with the respective cavities 16 at this stage.

When the terminal retainer 15 reaches the full locking position, the male terminal insertion openings 29 of the front-stop wall 28 align with the respective cavities 16.

The upper surface of a female terminal fitting 5 that stops far before its proper insertion position interferes with the terminal locking portion 18 and prevents the terminal locking portion 18 from being pushed in. Thus, an operator immediately notices that the female terminal fitting 5 is insufficiently inserted, and inserts it to the proper insertion position.

Female terminal fittings 5 that are inserted to their proper insertion positions abut against the front-stop wall 28 and can be locked by the terminal locking portion 18. These properly inserted terminal fittings 5 can be held in close contact with the connecting portions 6 as long as the female terminal fittings 5 are produced in specified dimensions, because the distance between the front-stop wall 28 and the terminal locking portion 18 substantially equals the entire length of the connecting portion 6 of the female terminal fittings 5, i.e. the distance between the front surfaces of the connecting portions 6 and the rear surface of the contact pieces 11.

The female connector housing F can be fit in the male connector housing M after the female terminal fittings 5 are doubly locked by the locking portions 10 and the terminal locking portion 18 in the female connector housing F. The locking projection 4 of the lock arm 25 contacts the engaging projection 3 of the male connector housing M as the female connector housing F is fit into the male connector housing M. The lock arm 25 is deformed elastically downward as the housings F, M are fit further and the locking projection 4 engages the engaging projections 3 for locking after slipping under it. As a result, the housings F, M are locked together. The operable piece 27 can be deformed elastically again to disengage the engaging projection 3 and the locking projection 4 to unlock the housings F, M.

As described above, the terminal locking portion 18 contacts the upper edges of the receiving pieces U of the respective female terminal fittings 5 when the terminal retainer 15 is in its full locking position. Thus, fine sliding abrasion can be avoided even if vibration of an automotive vehicle is transmitted to the female terminal fittings 5 via the wires W because the female terminal fittings 5 are held so as not to shake in the cavities 16. Further, in this embodiment, the receiving pieces U are arranged before the barrels or in a position between the barrels 12, 13 and the connecting portion 6*s*. Thus, the terminal fittings are not held in positions where the heights of their upper ends vary with the diameters of the wires W or where the diameters of the crimped barrel portions 12, 13 vary due to varying diameters of the wires W. Therefore, the receiving pieces U and the terminal locking portion 18 can contact each other regardless of the diameters of the wires.

The terminal retainer 15 of this embodiment also: determines the front end positions of the female terminal fittings 5; employs the terminal locking portion 18 to prevent the female terminal fittings 5 from coming out of the cavities 16; and presses the female terminal fittings 5 so as not to shake. Thus, the connector has few parts and a simple construction.

As described above, the space between the front-stop wall 28 and the terminal locking portion 18 equals the entire length of the connecting portion 6 of the female terminal fitting 5 because the front-stop wall 28 and the terminal locking portion 18 are integrally or unitarily formed at the terminal retainer 15. In the prior art connector, a dimensional variation was unavoidable for assembling reasons because the retainer was formed separately, and the dimensional variation resulted in the shake of the female terminal fittings 5. However, the connector of this embodiment avoids such a problem. As a result, this connector is protected from fine sliding abrasion. Further, since the contact pieces 11 and the guide surfaces 11*a* ensure that the leading end of the terminal locking portion 18 is guided smoothly backward on the guide surfaces 11*a* when the terminal retainer 15 is moved to its full locking position. As a result, the locking action can be carried out easily.

Various changes can be made in the present invention, and following modifications are also embraced by the technical scope of the present invention as defined in the claims.

Although the illustrated embodiment is applied to the female connector housing F, it may be applied to the male connector housing M.

Although the housing 9 is comprised of the main body 17 and the housing head 14 in the foregoing embodiment, it may have a unitary or integral construction.

The housing 9 is formed with two stages of cavities in the illustrated embodiment. However, the number of the stages of cavities is not limited, and there may be only one stage or three or more stages.

The contact piece of the terminal fitting may have a springback so as to be elastically deformable substantially in forward and backward or longitudinal directions. With such a contact piece, even if the distance from the leading end of the terminal fitting to the contact piece varies, the contact piece and the terminal locking portion are engaged elastically with each other. As a result, the above variation can be taken up.

Although the lock arm is formed on the terminal retainer in the foregoing embodiment, it may be formed on the housing.

Although the guide surface 11*a* is formed on the female terminal fitting 5 in the foregoing embodiment, it may be formed on the terminal locking portion 18 of the terminal retainer 15.

Although the guide surface 11 a is slanted in the foregoing embodiment, it may be a moderate arcuate surface.

The height of the receiving piece U may be adjustable. For example, the upper end of the receiving piece U may be turned inwardly in U-shape along its width to provide a springback so that the height of the upper end of the receiving piece U is adjustable. Thus, the terminal locking portion 18 and the receiving piece U can be brought securely into contact with each other by taking up variations from a manufacturing or assembling ground.

Although the terminal locking portion 18 is formed integrally or unitarily with the terminal retainer 15, they may be separately formed.

What is claimed is:

1. A shake preventing construction for a terminal fitting, comprising:

at least one terminal fitting with a front-stop wall and rear part defining a wire connecting portion for connection with a wire, a connector housing having opposite front and rear ends and at least one cavity extending between the ends for at least partly accommodating the terminal fitting, at least one resiliently deflectable lock extending into the cavity for locking the terminal fitting, a mount hole extending transversely into the connector housing and communicating with the cavity, and a terminal fixing device having a contact portion inserted in the mount hole for contacting the terminal fitting in a position before the wire connecting portion to prevent the terminal fitting from shaking, the terminal fixing device further having a front stop wall disposed externally of the connector housing and adjacent the front end of the housing, the front stop wall having at least one insertion opening aligned with the cavity and being cross-sectionally smaller than the terminal fitting for defining a front limit position for the terminal fitting in the cavity.

2. A shake preventing construction according to claim 1, wherein the terminal fixing device comprises a locking portion for locking the terminal fitting to prevent the terminal fitting from coming out of the cavity.

3. A shake preventing construction according to claim 2, wherein the terminal fitting comprises a connecting portion for connection with a mating terminal fitting, and a receiving piece disposed for contact with the contact portion, the receiving piece being between the connecting portion and the wire connecting portion.

4. A shake preventing construction according to claim 1, wherein at least one of the terminal fitting and the contact portion of the terminal fixing device are formed with a guide surface for guiding a locking operation of the terminal fixing device.

5. A shake preventing construction according to claim 1, wherein the terminal fixing device is engageable in a partial lock position where at least one communication hole therein is substantially aligned with the cavity such that the terminal fitting can be inserted into the cavity and the communication hole, the terminal fixing device being moveable to a full locking position such that the contact portion contacts the terminal fitting and locks the terminal fitting in the cavity.

6. A shake preventing construction according to claim 1, wherein the terminal fitting is provided with locking means for interacting with mating locking means in the connector housing to provide secondary locking means for locking the terminal fitting in the connector housing.

7. A shake preventing construction for terminal fittings, comprising;

a plurality of terminal fittings, each said terminal fitting having a front-stop wall and a rear part defining a wire connecting portion for connection with a wire;

a connector housing with a plurality of cavities for accommodating the terminal fittings; and a terminal fitting device having a plurality of communication holes, the terminal fixing device being engagable in the connector housing in a partial lock position where the communication holes therein substantially align with the respective cavities such that the terminal fittings can be inserted into the cavities and the communication holes, the terminal fitting device further being movable to a full locking position, the terminal fixing device comprising at least one contact portion for contacting the terminal fitting device in a position before the wire connecting portion when the terminal fitting device is in the full locking position to prevent the terminal fitting from shaking, wherein corresponding portions of one contact portion enter at least two adjacent cavities when the terminal fixing device is in the full locking position.

8. A shake preventing construction according to claim 7, wherein the terminal fixing device is formed with a front-stop wall for contacting the front end surface of the terminal fitting for determining a front end position of the terminal fitting.

9. A connector, comprising:

at least one terminal fitting formed with a engaging portion in a position spaced from a leading end thereof by a specified distance, a housing having opposite front and rear ends and at least one cavity extending between the ends for at least partly accommodating the terminal fitting, the cavity having a front end, at least one resiliently deflectable lock extending into the cavity for locking the terminal fittings, a mount hole extending into the housing at a location between the front and rear ends and communicating with the cavity, and a terminal retainer at least partly mounted into the housing, the terminal retainer having a front-stop wall located externally of the housing and adjacent the front end of the housing, substantially at the front end of the cavity and held substantially in contact with the leading end of the terminal fitting, and a terminal locking portion integrally provided at a position spaced from the front-stop wall by a specified distance, the terminal locking portion being disposed in the mount hole for engagement with the engaging portion.

10. A connector according to claim 9, wherein the specified distance by which the engaging portion is spaced from the leading end of the terminal fitting substantially equals the specified distance by which the locking portion is spaced from the front-stop wall.

11. A connector according to claim 10, wherein at least one of the engaging portion of the terminal fitting and the terminal locking portion of the terminal retainer is formed with a guide surface for guiding the terminal locking portion of the terminal retainer into a locking position.

12. A connector according to claim 11, wherein the terminal retainer is movable between a partial locking position where the terminal retainer does not hinder insertion of the terminal fitting into the cavity and a full locking position where the terminal locking portion is substantially engaged with the engaging portion of the terminal fitting to prevent the terminal fitting from coming out of the cavity.

13. A connector according to claim 12, wherein the terminal fitting comprises a connecting portion at the leading end thereof for the connection with a mating terminal fitting, the connecting portion having a length equal to the specified distance and comprising the engaging portion.

* * * * *